US006021801A

United States Patent [19]

Sheppard

[11] Patent Number: 6,021,801

[45] Date of Patent: Feb. 8, 2000

[54] VALVES

[76] Inventor: Raymond William Sheppard, 7 Wythburn Close, Burnley, United Kingdom, BB128XE

[21] Appl. No.: 08/931,203

[22] Filed: Sep. 17, 1997

[30] Foreign Application Priority Data

Sep. 21, 1996 [GB] United Kingdom ..... 9619739

[51] Int. Cl.[7] ..... F16K 31/58

[52] U.S. Cl. ..... 137/242; 222/148; 222/513; 251/231; 251/342; 251/348; 251/349; 251/354

[58] Field of Search ..... 137/242; 222/148, 222/505, 513, 517, 533, 536, 547, 402.12, 402.21; 239/455; 251/231, 342, 348, 349, 354

[56] References Cited

U.S. PATENT DOCUMENTS

| | | | |
|---|---|---|---|
| 274,447 | 3/1883 | Kennish | 251/342 |
| 1,730,436 | 10/1929 | Rose | 251/342 |
| 3,146,922 | 9/1964 | Tuttle, Jr. | 222/402.12 |
| 3,155,291 | 11/1964 | Wakeman | 222/402.12 |
| 3,161,331 | 12/1964 | Murtha | 222/402.12 |
| 3,169,673 | 2/1965 | Focht | 222/402.12 |
| 3,174,694 | 3/1965 | Kitabayashi | 251/342 |
| 3,186,683 | 6/1965 | Azechi | 251/342 |
| 3,254,676 | 6/1966 | Beard, Jr. | 222/402.12 |
| 3,378,205 | 4/1968 | Barker | 222/402.12 |
| 3,749,360 | 7/1973 | Leimbach | 251/348 |
| 5,340,031 | 8/1994 | Neuhaus et al. | 222/402.12 |

*Primary Examiner*—George L. Walton

*Attorney, Agent, or Firm*—Anthony J. Casella; Gerald E. Hespos

[57] ABSTRACT

A fluid product valve in which an elastic member containing a normally closed slit is adapted to be selectively stretched by displacement of an actuating member, such as to stretch open the slit over the outlet end of a product discharge passage and allow fluid product to be dispensed therefrom, release of the actuating member allowing the elastic member, and hence the distorted slit, to return to its original configuration, thereby reclosing the outlet end of the passage.

9 Claims, 3 Drawing Sheets

VALVES

The present invention relates to valves. The invention is particularly, but not exclusively, applicable to valves for dispensers for dispensing edible fluid products.

Dispensers of this type are widely used as food containers and are adapted to dispense a required portion of a product, such as whipped cream, by manual operation of a delivery valve on the container, the food in the form of a jet or stream being emitted from the container via a nozzle of the delivery valve. A typical whipped cream (or other fluid food product) dispenser of this type usually comprises a piping tube forming the nozzle of the delivery valve, the piping tube being disposed externally to a sealable outlet of a main container body and being pivotally mounted on the container body such that when the nozzle/piping tube is pivoted manually towards, and pressed onto, the sealable outlet of the delivery valve by way of an actuator button, the delivery valve opens and the cream is dispensed via the nozzle/piping tube. Release of hand pressure from the nozzle actuator causes the delivery valve to close, thereby resealing the container.

However, a portion of dispensed cream will remain in the nozzle. It is therefore necessary to manually rotate the nozzle away from the delivery valve in order to allow running water, from a tap, to pour through the nozzle in order to remove the remaining cream. This is inconvenient for the user. Also, it is difficult to remove all traces of the remaining cream by this method. Residues of cream remaining in the nozzle will become contaminated and will consequently contaminate any further portions of cream dispensed from the container. Furthermore, the cream will set and a buildup of residues of cream within the nozzle will eventually block the nozzle, making it impossible to dispense any further portions of cream from the container. This is a particular problem if the nozzle has not actually been rinsed.

It is an object of the present invention to provide a valve which overcomes, or alleviates, the above described drawbacks.

In accordance with the present invention, there is provided a valve in which an elastic member containing a normally closed slit is adapted to be selectively stretched by displacement of an actuating member, such as to stretch open the slit over the outlet end of a product discharge passage and allow fluid product to be dispensed therefrom, release of the actuating member allowing the elastic member, and hence the distorted slot, to return to its original configuration, thereby reclosing the outlet end of the passage.

Preferably, the contracting slit is arranged to slide over the outlet end of the passage during its return to its original configuration, so as to re-close the outlet end of the passage with a self-wiping action.

This has the advantage that the outlet end of the product discharge passage can be fully closed by the elastic member in the non-stretched condition, whereby any product remaining in the passage will be sealed from the outside air and contamination of the product will be prevented. As a result of the self-wiping action of the elastic member over the outlet end of the product discharge passage, the outlet end of the passage is kept clean at all times when dispensing has been terminated. The use of a contracting aperture in an elastic member as the final outlet for the food product means that when the aperture finally closes, any food product therein is forcibly expelled by the inherent elasticity of the elastic member whereby all that is usually necessary to ensure a completely clean outlet is to run a tissue or cloth over the region around the slit once the slit has returned to its closed condition.

The product discharge passage is usually connected permanently to the interior of a container carrying the food product to be dispensed. In a typical case, the product would be housed in the container under pressure. However, in some embodiments, the product need not be permanently pressurised but could be expelled by, for example, squeezing flexible sides of the container.

In one preferred embodiment, the product discharge passage is in the form of a tube having an outlet end portion which can be selectively tilted in a substantially arcuate movement by manual displacement of said actuating member, this tilting movement being arranged to cause said stretching of the elastic member to open the slit over the outlet end of the tube.

Preferably, the slit is located in the elastic member so that it only aligns with the exit end of the tube when it has been fully opened as a result of the elastic member being stretched by the tilting movement of the tube. This has the advantage of providing a simple means of self-wiping the operating parts of the valve, in that the contracting distorted slit moves across the exit end of the tube whereby the edges of the contracting slit will scrape across the end of the tube, thereby cleaning the slit/outlet connection.

Preferably, the tube comprises two longitudinal sections joined by an annular resilient seal which allows one section of the tube to be fixed to the food product container, while the other section can be tilted relative to said one section for causing the distortion of the elastic member containing the slit.

The invention is described further hereinafter, by way of example only, with reference to the accompanying drawings, wherein.

Figure 3:
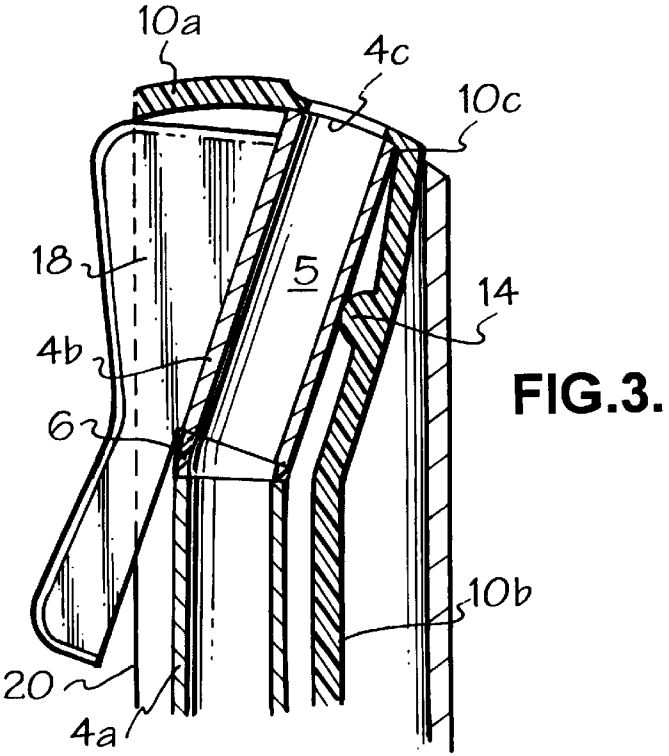
FIG. 3 is a view of the valve of FIG. 1 showing the valve in an open/flow-through condition.

The valve illustrated in the drawings comprises a rigid housing 2 which in use is adapted to be attached to the top of a pressurized container (not shown) of a fluid food product, such as cream, custard or the like. Disposed along the interior of the housing 2 is a flexible tube 4 made from a food-grade plastics material and in two longitudinal sections 4*a*, 4*b* which are joined in a fluid-tight manner by a flexible annular seal 6 made of silicone rubber. The tube 4 defines a product discharge passage 5 and is in permanent connection with the interior of the pressurised container and therefore, in use, is filled with pressurised fluid food product from the container.

The valve further includes a substantially L-shaped, flexible seal member 10 of food grade silicone rubber which is disposed within the housing 2 and comprises a shorter leg portion 10*a* and a longer leg bportion 10*b*. The distal end of the longer leg 10*b* is fixed to the container by means not shown. The two opposite side regions 12*a*, 12*b*, of a major part of the shorter leg 10*a* are fixed permanently to parallel side regions 14*a*, 14*b* of a rim part 14 of the housing 2. The underside of the shorter leg 10*a* of the L-shaped seal member 10 extends over and is in sliding contact with the discharge end 4*c* (upper end as viewed in FIGS. 1 and 3) of the tube 4. The longer leg 10*b* of the L-shaped seal member 10 extends within the housing 2 along the length of the tube 4 and between the tube 4 and a housing wall 2*a*. The longer leg 10*b* incorporates a ridge 14 which contacts the part 4*b* of the tube 4. The region of the shorter leg 10*a* of the L-shaped seal member is of reduced thickness and is formed with a normally closed, transversely extending, linear slit 16 of length substantially equal to the diameter of the tube 4 at its median thickness.

Figure 1:
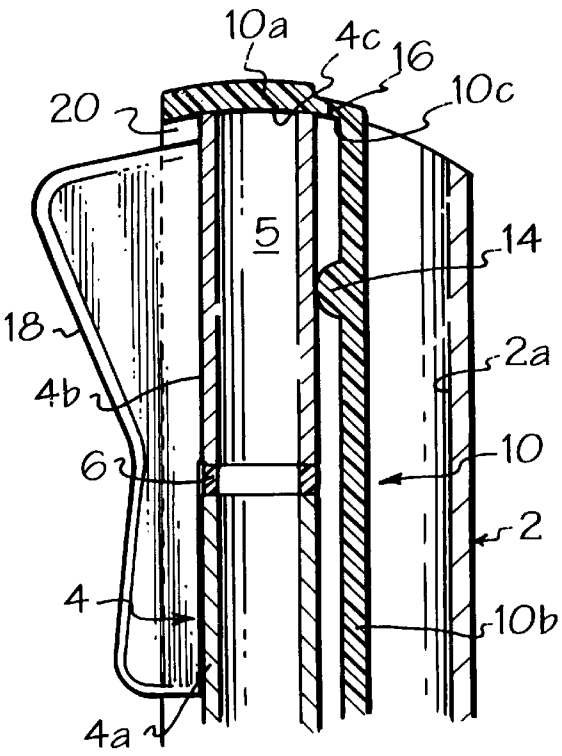
FIG. 1 is a schematic sectional view of one embodiment of a valve in accordance with the present invention, showing the valve in a closed/shut off condition.
Figure 2:
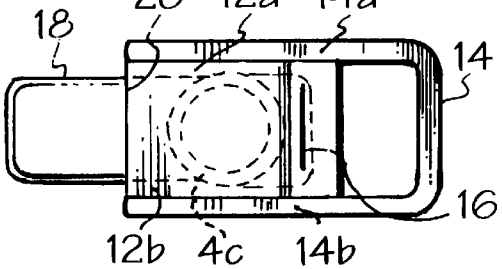
FIG. 2 is a schematic plan view of the valve of FIG. 1.

As shown in FIGS. 1 and 2, the (closed) slit 16 is disposed to one side of the tube 4 when the valve is in its non-actuated state, the discharge end 4*c* of the tube 4 being completely sealed off by the shorter leg 10*a* of the L-shaped seal 10 in this condition.

Firmly attached to the upper part 4*b* of the tube 4 is an actuator button 18 which is designed to be manually depressed for operating the valve, preferably by the user's thumb. For this purpose, at least part of the actuator button 18 extends out of the housing 2 through a housing aperture 20.

Figure 4:
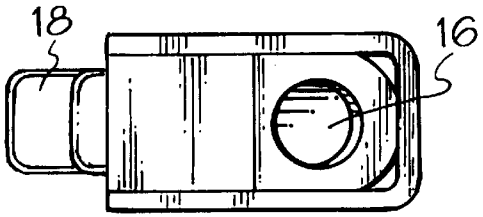
FIG. 4 is a plan view of the valve in the open condition shown in FIG. 3.

The valve is operated by pressing the actuator button 18 into the housing, whereby the upper part 4*b* of the tube 4 is tilted relative to the lower part 4*a* about its resilient connection 6 with the lower part 4*a* as shown in FIG. 3. As a result of this tilting movement of the tube part 4*b*, its upper, discharge end 4*c* moves along the underside of the shorter leg portion 10*a* of the L-shaped seal 10 and eventually meets the corner portion 10*c* of the seal 10 where the longer and shorter legs 10*a*, 10*b* are connected. Further tilting movement of the tube part 4*b* then causes the reduced thickness part of the shorter leg portion 10*a* to be stretched longitudinally, thereby causing the linear slit 16 to open and assume an approximately oval configuration which comes into axial alignment with the discharge end 4*c* of the tube 4 so as to bring the valve into an open state (see in particular FIG. 4). The fluid food product can be discharged from the container in this open condition of the valve.

When sufficient product has been dispensed and the manual pressure on the actuator button 18 is released, the resilience of the material of the seal 10 causes the upper tube part 4*b* and the actuator button 18 to be returned to their original positions of FIGS. 1 and 2. The shorter leg 10*a* of the seal 10 is thereby no longer stretched and the slit 16 closes again. As the trailing edge of the discharge end 4*c* of the tube part 4*b* moves back across the closing slit, there occurs a mutual scraping action between the slit edges and the discharge end 4*c* of the tube part 4*b* whereby any residue of the food product flowing through the valve is forcibly expelled from the slit.

The inlet (lower) end of the tube 4 of the valve is provided with means, not illustrated, such as a threaded bore for attachment to the container. In an alternative arrangement, the valve could be formed as a unitary structure with the container.

Figure 5:
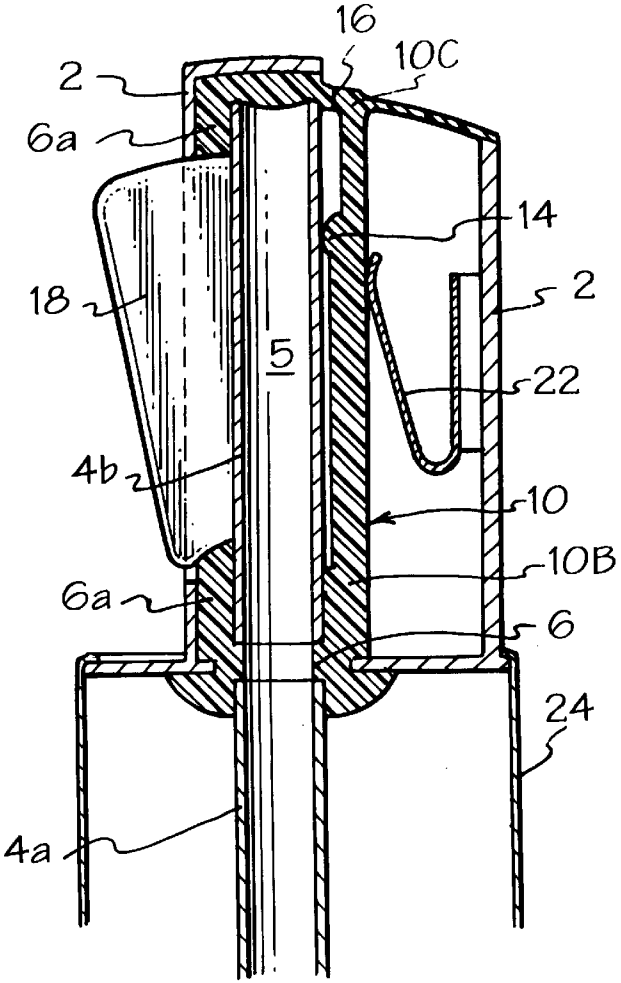
FIG. 5 is a schematic sectional view of a second embodiment of a valve in accordance with the present invention.

In some embodiments, it can be advantageous to include a discrete spring member between the longer leg 10*b* and the housing wall 2*a* to assist the return movement of this leg 10*b* and hence the closure of the valve. The construction of an example of such an embodiment is illustrated in FIG. 5 and its operation is illustrated in FIGS. 6 to 9. In FIGS. 5 to 9, components which are the same as or equivalent to parts in the embodiment of FIGS. 1 to 4 are given the same reference numbers.

The principal difference in the FIG. 5 embodiment is the use of a leaf spring 22 to assist in returning the valve to its closed position. In this purpose one end of the spring 22 is rigidly fixed to the housing wall 2 and the other, free end engages against the back of the longer leg 10*b* of the flexible seal member 10. The spring is compressed between the leg 10*b* and wall 2 when the button/trigger 18 is operated for opening the valve so that the valve is returned to the closed position when the compressed spring expands again when the force on the button 18 has been released.

Other differences in the FIG. 5 embodiment arise from the arrangement wherein instead of a discrete annular seal 6 of silicone rubber for allowing the flexibility between the tube sections 4*a* and 4*b*, the annular seal 6 is an integral part of a mass of silicone rubber 6*a* which extends from within the container main housing 2 to the left-hand top region of the housing 2 of the valve (as viewed in FIG. 5).

FIGS. 6 to 9 illustrate the operation of the embodiment of FIG. 5.

Figure 6:
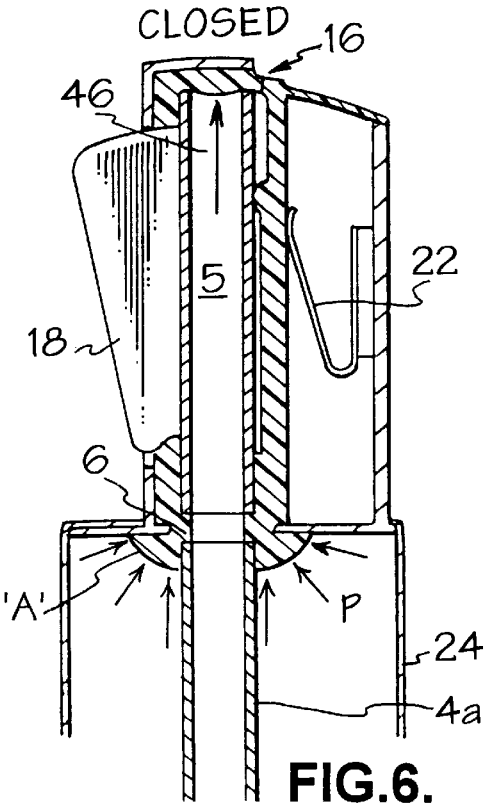
FIGS. 6–9 illustrate the operation of the embodiment of FIG. 5.

In FIG. 6, the valve is in its closed state and no actuating force is being applied to the trigger 18. Pressure "P" on the part spherical surface of the silicone rubber 6*a* extending into the main container housing 24 drives the spout formed by the tube part 4*b* into sealing abutment with the underside of the shorter leg 10*a* of the flexible seal member 10.

Figure 7:
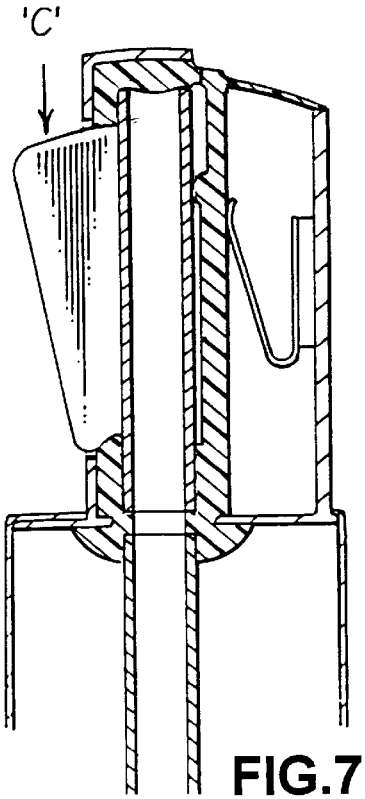

FIG. 7 shows the initial operation of the valve. Vertical pressure is applied on the trigger 18 in the direction of arrow "C" which opposes the gas pressure in the container to ease the contact pressure of the spout on the seal area.

Figure 8:
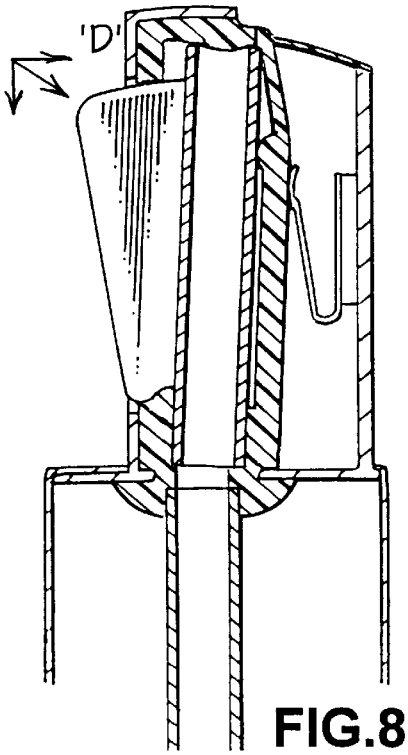

FIG. 8 shows the continuing opening operation of the valve wherein pressure on the trigger is moved to an angle to the vertical (indicated approximately by direction line "D") so as to move the spout horizontally towards the open position whilst maintaining a vertical pressure to ease the sealing pressure.

Figure 9:
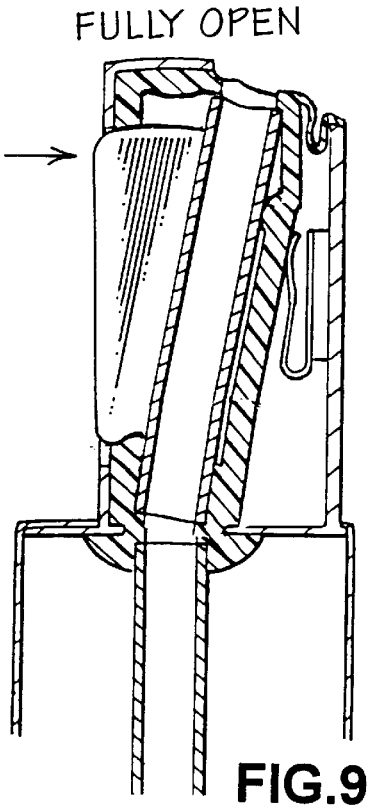

FIG. 9 shows the fully open condition of the valve wherein the trigger 18 has been moved fully to the right. In the continuing movement of the trigger 18 horizontally to reach this fully operated state, the spout extends the flexible leg 10*a* local to the slit 16 thereby opening the slit 16 to form the discharge opening. Pressure is maintained on the spout at this time by virtue of the elastic properties of the seal member 10. The flow rate is determined by the angle to which the spout is inclined.

Although not mentioned above, a similar operating sequence is preferably also applied in the case of the first embodiment of FIGS. 1 to 4, ie including an initial downward pressure which is gradually changed to a horizontal pressure as per FIGS. 6 to 9.

In other embodiments, the tube 4 need not be tiltable but could remain in a fixed position to the right of the slit 16 as viewed in FIG. 1. In this case, movable means other than the tube and actuator button could be provided for displacing the corner portion 10*c* of the L-shaped member so as to stretch the reduced thickness portion of the upper leg and open the slit.

Figure 10:
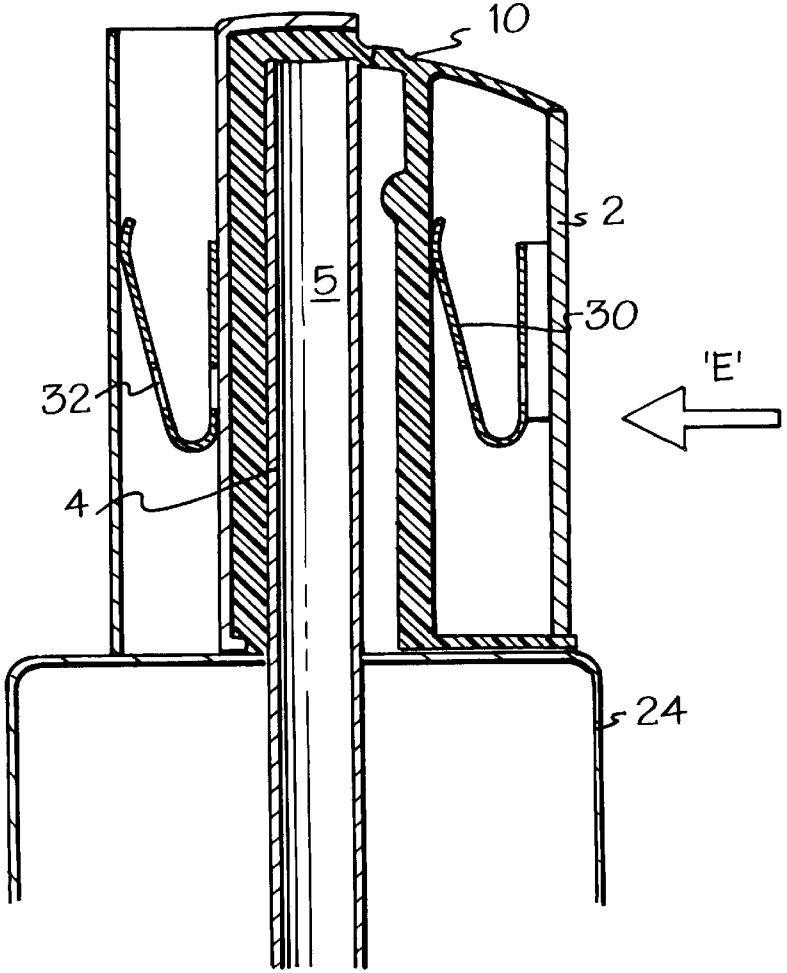
FIG. 10 is a schematic sectional view of a third embodiment of a valve in accordance with the present invention.

An example of an embodiment having a fixed, non-tiltable tube 4 is shown in FIG. 10. This embodiment has two return springs 30, 32 which become effective in sequence as pressure is applied in the direction of arrow "E" to open the valve. Initial pressure in direction "E" moves the slit over the top end of the tube/spout 4. Continuing pressure in direction "E" opens the orifice by stretching the slit over the top end of the fixed tube/spout 4. As before, the seal pocket 10 is formed of food grade elastomer. Thus, the embodiment of FIG. 10 is effectively the converse of FIG. 1 is that in FIG. 10 a movable slit is stretched over a stationary spout whereas in FIG. 1 a stationary slit is stretched over a movable spout.

The valves of the present invention are not restricted to use with containers which are permanently pressurised but could also be used with containers which are adapted to be squeezed for dispensing the contents. In some arrangements of the latter type, one hand of the user could operate the valve while the other hand was used to squeeze the container. In other embodiments, the action of squeezing the container could also be arranged to cause stretching of the elastic material having the slit, such as to open the slit in alignment with the discharge end of the tube.

Because the valve is self-sealing, it is particularly well adapted to provide the discharge valve/nozzle for a container of an edible product. This allows any product remaining in the discharge valve/nozzle to be sealed from the environment, thereby preventing contamination of the product.

I claim:

1. A valve for use in dispensing a fluid product from a fluid product container, comprising:

means for defining a product discharge passage having an inlet end coupled to the interior of said fluid product container and an outlet end;

an actuating member for operating the valve; and an elastic member having a normally closed slit, said elastic member being disposed and configured to be selectively stretched by displacement of said actuating member, such as to distort and stretch open said slit and to align said slit with said outlet end of said product discharge passage, said open slit allowing fluid product to be dispensed therefrom, release of said actuating member allowing said elastic member, and hence said distorted slit, to return to its original closed configuration and causing portions of said elastic member adjacent said slit to slide over said outlet end of said product discharge passage with a self-wiping action and further causing said slit to move out of alignment with said outlet end, thereby reclosing said outlet end of said product discharge passage.

2. A valve according to claim 1, wherein said product discharge passage is defined by a tube having a first portion carrying said outlet end, said first portion being selectively tiltable in a substantially arcuate movement by manual displacement of said actuating member, the latter tilting movement being arranged to cause said stretching of said elastic member to open said slit over said outlet end of said tube.

3. A valve according to claim 2, including a spring means for assisting in returning said valve to its normally closed position.

4. A valve according to claim 2, wherein said tube comprises two longitudinal sections joined by an annular resilient seal which allows one section of said tube to be fixed to said fluid product container, while the other section, defining said first portion carrying said outlet end can be tilted relative to said one section for causing said distortion of said elastic member containing said slit.

5. A valve according to claim 4, wherein said slit is located in said elastic member so that it only aligns with said outlet end of said tube when it has been substantially fully opened as a result of said elastic member being stretched by said tilting movement of said tube.

6. A valve according to claim 4, wherein said elastic member is substantially L-shaped and comprises a first, shorter leg containing said slit and a second, longer leg which extends substantially parallel to said product discharge passage.

7. A valve according to claim 4, wherein said elastic resilient seal is an integral part of said elastic member defining said slit.

8. A valve according to claim 7, wherein said elastic member also has a portion which extends through an outlet aperture of said food product container to which the valve is mounted so as to provide a fluid tight seal therebetween.

9. A valve according to claim 1, wherein said product discharge passage is defined by a rigid tube and wherein said elastic member containing said slit is adapted to be displaced by operation of said actuating member for stretching open said slit over said outlet end of said product discharge passage.

* * * * *